US007148623B2

(12) United States Patent
Vlaskin et al.

(10) Patent No.: US 7,148,623 B2
(45) Date of Patent: Dec. 12, 2006

(54) FLEXIBLE ELECTROLUMINESCENT MATERIAL

(75) Inventors: Vladimir Vlaskin, 13316 Cardinal Ridge #C, Chino Hills, CA (US) 91709; Philip Chan, San Marino, CA (US)

(73) Assignee: Vladimir Vlaskin, Chino, CA (US)

( * ) Notice: Subject to any disclaimer, the term of this patent is extended or adjusted under 35 U.S.C. 154(b) by 9 days.

(21) Appl. No.: 10/878,843

(22) Filed: Jun. 28, 2004

(65) Prior Publication Data

US 2005/0285515 A1 Dec. 29, 2005

(51) Int. Cl.
*H01J 1/62* (2006.01)
*H01J 63/04* (2006.01)

(52) U.S. Cl. ..... 313/506; 313/503; 313/504; 313/509; 313/511; 313/512; 156/230; 156/540; 445/24; 445/25

(58) Field of Classification Search ..... 313/511, 313/512, 509, 504, 503; 445/24, 25; 156/230, 156/540
See application file for complete search history.

(56) References Cited

U.S. PATENT DOCUMENTS 5,482,896 A * 1/1996 Tang ..... 438/28
5,856,030 A 1/1999 Burrows ..... 428/690
5,912,533 A 6/1999 Lee et al. ..... 313/593
6,133,693 A 10/2000 Keyser ..... 313/506
6,406,803 B1 6/2002 Abe et al. ..... 428/690
6,579,631 B1 6/2003 Lee ..... 428/690
2003/0090199 A1* 5/2003 Saita et al. ..... 313/509

* cited by examiner

*Primary Examiner*—Nimeshkumar D. Patel
*Assistant Examiner*—Anthony Canning

(57) ABSTRACT

A method forming a flexible EL device comprising the steps of:

1) forming the non-adhesive shield polymer layer (2) on the plastic film layer (1);
2) forming a back conductive electrode layer (3) on the non-adhesive shield polymer layer (2);
3) forming dielectric layer (4) comprising a mixture of high-dielectric constant powder and binder on the back conductive electrode layer (3);
4) forming first field polymer layer (5) on the dielectric layer (4).
5) forming a phosphor layer (6) comprising encapsulated phosphor and binder on the first field polymer (5);
6) forming second field polymer (7) on the phosphor layer (6).
7) forming the transparent electrode layer (8) by using conductive polymer comprising transparent conductive materials on the second field polymer layer (7);
8) forming a polymer protection layer (9) on the transparent electrode layer (8); and
9) then separating the EL cell (2–9 layers) from plastic film.

18 Claims, 2 Drawing Sheets

FLEXIBLE ELECTROLUMINESCENT MATERIAL

BACKGROUND OF THE INVENTION

1. Field of the Invention

The present invention relates to a flexible electroluminescence (EL) cell which is activated by an alternating electrical current (AC). More particularly, the present invention is directed to an easy-to-fabricate, flexible EL cell having non-adhesive properties to the plastic film substrate upon which it was formed as well as having a transparent conductive organic polymer layer contained therein.

2. Brief Description of Art

EL devices comprising a so-called "dispersion-type luminescent layer" which is formed by dispersing luminescent particles such as fluorescent substances in a matrix resin such as a polymer having a high dielectric constant are known from the following publications:

For example, JP-B-14878 discloses an EL device comprising a transparent substrate, a transparent electrode layer, an insulating layer consisting of a vinylidene fluoride base matrix resin, a luminescent layer comprising a vinylidene fluoride base matrix resin and fluorescent particles, the same insulating layer as above, and a rear electrode, which are laminated in this order.

JP-B-62-59879 discloses an EL device comprising a polyester film, an Indium Tin Oxide (ITO) electrode, a luminescent layer comprising a cyanoethylated ethylene-vinyl alcohol copolymer (a matrix resin) and fluorescent particles, and an aluminum foil (a rear electrode), which are laminated in this order.

U.S. Pat. No. 5,912,533 discloses an EL device whose front transparent electrode is made by using transparent conductive powder and transparent conductive binder. This EL device is made by a method comprising the steps: providing a substrate; forming a metal electrode layer on the substrate, wherein the metal electrode layer reflects light incident thereto; forming a dielectric layer comprising a mixture of dielectric powder and a binder on the metal electrode layer; forming a phosphor layer including phosphor powder and a binder on the dielectric layer; and forming a transparent electrode layer including transparent conductive powder and a transparent conductive binder on the phosphor layer using a spin coating or a screen printing process employed for liquid material.

FIG. 1 shows a cross-sectional view of a conventional EL device as described in U.S. Pat. No. 5,912,533.

The EL device shown in FIG. 1 comprises a plurality of layers including a substrate 11, a back electrode layer 10, a dielectric layer 4, a phosphor layer 6, a transparent electrode layer 1, and a polymer protection layer 5.

To fabricate the prior art EL device shown in FIG. 1, the back electrode layer 10 is first deposited on top of the substrate 11. Then, the dielectric layer 4 is formed on the electrode layer 10. The dielectric layer 4 may be made of a mixture of dielectric powder and binder for binding the dielectric powder, or a dielectric thin film. The dielectric powder may be $BaTiO_3$, whose particle size is less than 3 micron. The binder, for example, may be made of a mixture of PVA (polyvinyl alcohol) type polymer and DMF (dimethylformamide) which works as a plasticizer. Next, the phosphor layer 6 is formed on the dielectric layer 4 by applying a mixture of phosphor powder 7 and binder 8 which binds the phosphor particles 7 together. The phosphor powder may be a II-VI group compound, e.g. ZnS. The particle size of the phosphor powder 7 ranges preferably from about 20 to 30 micron. It should be noted that the amount of the binder 8 required in the invention is less than that used in the conventional phosphor layer. As a result, an upper part of the phosphor particles 7 is exposed to be in contact with the transparent electrode layer 1 as shown in FIG. 1. It is possible to obtain three primary colors of light, i.e., red, green and blue, by mixing pertinent materials into the phosphor when forming the phosphor layer 6. For example, by adding Samarium (Sm) to ZnS, or by adding Cu, Mn and Cl to ZnS, red is obtained; by adding Terbium (Th) to ZnS, or by adding Copper (Cu) and Chlorine (Cl) to ZnS, green is obtained. By adding Thulium (Tm) to ZnS or by adding Cu and Cl to ZnS, blue is obtained. By making a layer with a mixture of materials related to the three colors, white light can be obtained. By using color filters on the white phosphor layer, it is possible to obtain various kinds of colored light. Subsequent to the formation of the phosphor layer 6, transparent electrode layer 1 is formed thereon by applying a mixture of ITO powder 2 and conductive binder 3. It is preferable to form the transparent electrode layer 1 by pressing the ITO powder and conductive binder 3 mixture with instant heating at the temperature of 100–200° C. so that the particles in the transparent electrode layer 1 are compactly arranged and the adhesion between the phosphor and transparent electrode layers is improved. As the transparent electrode layer 1 of the prior invention is made of material in a liquid state instead of the ITO thin film used in the conventional device. Moreover, as the phosphor powder 7 directly contacts the electrode layer 1, a strong electric field can be applied to the phosphor powder 7.

In this case the dielectric layer 4, phosphor layer 6, transparent electrode layer 1 are made of a material in a liquid state, i.e. a mixture of powder and binder, and can be easily fabricated by employing a spin coating or a screen printing method. During a spin coating process, a liquid material is poured on a substrate which is rotated so that the material is spread into a thin and uniform layer. During a screen printing process, a liquid material is put on a mesh made of silk or stainless steel and then rubbed with a soft plastic bar to allow it to pass through the mesh thereby forming a thin and uniform layer on a substrate.

It may be appreciated that the EL device shown in FIG. 1 has some disadvantageous effects including the low dielectric strength, high power consumption, low resolution capability by shaping or forming layers during lamination, high dielectric losses, major thickness of the device (0.3 mm), low efficiency, short a lifetime, poor flexibility.

U.S. Pat. No. 6,406,803 teaches making an EL device having a transparent substrate, a transparent conductive layer, a luminescent layer comprising luminescent particles and a matrix resin, and a rear electrode, wherein the luminescent layer has a transparent support layer comprising a matrix resin and the insulating layer comprising an insulating material, and a luminescent particle layer consisting essentially of particles which comprise luminescent particle and are embedded in both the support layer and the insulating layer.

U.S. Pat. No. 6,579,631 teaches making an EL device that includes a substrate, a lower electrode layer formed on the substrate, a light-emitting layer formed on the lower electrode layer, an upper electrode layer formed on the light-emitting layer, and a passivation layer formed on the upper electrode layer. The method for manufacturing an electroluminescence device includes the steps of forming a lower electrode layer on a substrate, forming a light-emitting layer on the lower electrode layer, forming an upper electrode layer on the light-emitting layer, and forming a passivation layer on the upper electrode.

These prior art EL devices have some disadvantages that include low dielectric strength, high power consumption, low resolution capability at the shaping or forming layer, high dielectric losses, major thickness of the device (0.3 mm), low efficiency, short operation life and poor flexibility. Many of these disadvantages are caused by the inclusion of an outer substrate layer in the EL device layer. It has now been found that EL devices not containing such an outer substrate layer do not have many of those disadvantages.

BRIEF SUMMARY OF THE INVENTION

Therefore, one aspect of the present invention is directed to flexible EL device/plastic film substrate composite that comprises:

a) a plastic film substrate;

b) a non-adhesive shield polymer layer formed on the substrate;

c) back electrode layer formed on the non-adhesive shield polymer layer, said back electrode layer comprising a mixture of a conductive powder with an organic polymer binder or conductive organic polymer;

d) dielectric layer formed on the back electrode layer, said dielectric layer comprising a mixture of high-dielectric constant powder and binder;

e) first field polymer layer formed on the dielectric layer;

f) phosphor layer formed on the first field polymer layer, said phosphor layer comprising encapsulated phosphor material and binder;

g) second field polymer layer formed on the phosphor layer;

h) front transparent electrode layer formed on the second field polymer layer, said transparent electrode layer comprising transparent organic conductive material; and i) polymer protection layer formed on the front transparent electrode layer.

Another aspect of the present invention is directed to a flexible EL device comprising:

a) non-adhesive shield polymer layer;

b) back electrode layer formed on the non-adhesive shield polymer layer, said back electrode layer comprising a mixture of a conductive powder with an organic polymer binder or conductive organic polymer;

c) dielectric layer formed on the back electrode layer, said dielectric layer comprising a mixture of high-dielectric constant powder and binder;

d) first field polymer layer formed on the dielectric layer;

e) phosphor layer formed on the first field polymer layer, said phosphor layer comprising encapsulated phosphor material and binder;

f) second field polymer layer formed on the phosphor layer;

g) front transparent electrode layer formed on the second field polymer layer, said transparent electrode layer comprising transparent organic conductive material; and h) polymer protection layer formed on the front transparent electrode layer.

Still another aspect of the present invention is directed to a method forming an EL device comprising the steps of:

1) forming a non-adhesive shield polymer layer (2) on a plastic film substrate layer (1); and then heat treating at the temperature of 80–170° C.;

2) forming a back conductive electrode layer (3) comprising a mixture of a conductive powder with an organic polymer binder or organic conductive material on the non-adhesive shield polymer layer (2); and then heat treating at the temperature of 80–170° C.;

3) forming dielectric layer (4) comprising a mixture of high-dielectric constant powder and binder on the back conductive electrode layer (3); and then heat treating at the temperature of 80–170° C.;

4) forming first field polymer layer (5) on the dielectric layer; and then heat treating at the temperature of 80–170° C.;

5) forming a phosphor layer (6) comprising encapsulated phosphor material and binder on the first field polymer (5); and then heat treating at the temperature of 80–170° C.;

6) forming second field polymer (7) with polymer binder on the phosphor layer.

7) forming the transparent electrode layer (8) by using at least conductive polymer comprising transparent organic conductive materials on the second field polymer layer (7); and then heat treating at the temperature of 80–170° C.;

8) forming a polymer protection layer (9) on the transparent electrode to form an EL sell; and then heat treating at the temperature of 80–170° C.;

9) then separating the layers 2–9 of EL cell from the plastic film substrate layer (1).

The beneficial effects resulting from the present invention include the following: It is possible to fabricate thin EL cell (i.e. thinner then 100 micron). The inventive device has the following properties. It is highly flexible. This EL cell can luminance under higher high voltage and frequency. This EL cell has high-resolution capability at forming layer. This EL cell has high efficiency. And, it is possible to fabricate all layers of this EL cell by using the screen printing method and after the EL cell is separated from plastic film; cutting equipment is not needed.

DETAILED DESCRIPTION OF THE INVENTION

Figure 1:
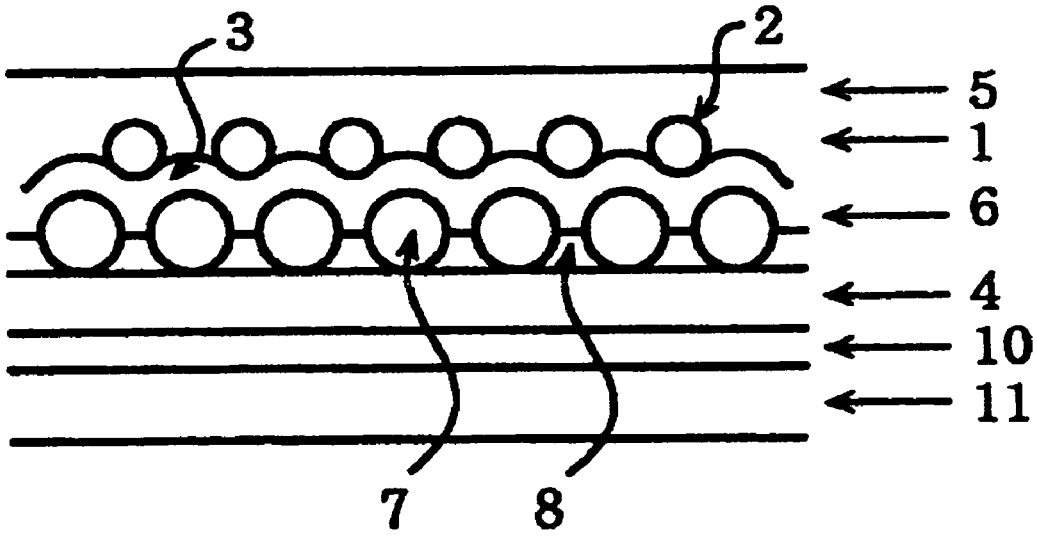
Figure 1 Prior Art
FIG. 1 is directed to a cross-sectional view of a prior art EL device as described in U.S. Pat. No. 5,912,533.
Figure 2:
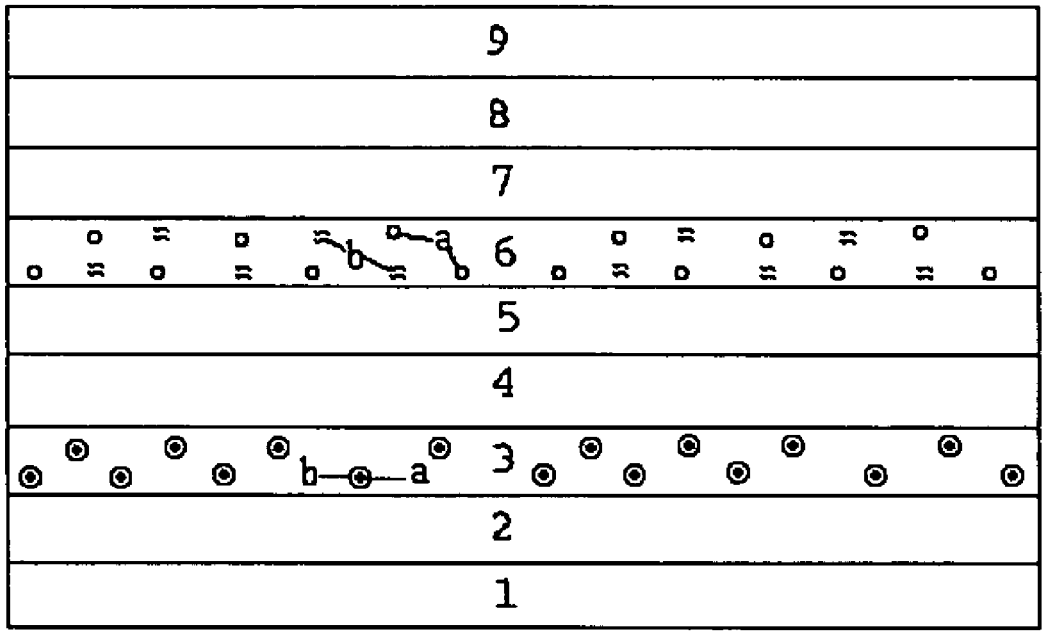
FIG. 2 is directed to a cross-sectional view of an EL device of the present invention.

The prior invention became apparent from the following descriptions of preferred embodiments taken in conjunction with the accompanying FIG. 2, in which the configuration and operation of the present invention is shown.

The EL device shown in FIG. 2 comprises a plurality of layers including a plastic film 1, a non-adhesive shield polymer layer 2, a back electrode layer 3, a dielectric layer 4, a first field polymer layer 5, a phosphor layer 6, a second field polymer layer 7, a front transparent electrode layer 8, and the polymer protection layer 9.

To fabricate the present EL cell shown in FIG. 2 a non-adhesive shield polymer layer 2 is first printed on a plastic film 1. Preferably the plastic film layer 1 may be for example a poly(ethylene terephthalate) (PET) film or polycarbonate film. The plastic PET film layer may preferably range from about 0.001 to 0.01 inches thick. The width and length dimensions of this plastic film substrate 1 will be at least the width and length of the EL cell to be made. The non-adhesive shield polymer layer 2 may be any polymer material that has poor adhesion to the plastic film. Suitable types include silicon-type resins (for example, dimethylsiloxane rubber), UV resins (for example, polyurethane UV coating), IR resins (for example, acrylic resin or vinyl resin) and high resistivity polymers (for example, linear triblock copolymer based on styrene and ethylene/butylenes). The non-adhesive shield polymer layer 2 may be formed on the plastic film by a suitable means. The preferred method is a screen-printing method. The screen-printing method represents a process in which a layer is allowed to pass through the mesh made of silk or stainless thereby forming a uniform layer. The thickness of this non-adhesive shield polymer layer 2 may more preferably range from about 0.0001 to 0.005 inches. It should be noted that the width and length dimensions of this non-adhesive shield polymer layer 2 do not have to be the same dimensions of the plastic sheet (e.g. it may be smaller). Since the EL cell (2–9 layers) is removed from plastic film 1 (e.g. peeled away) at the end of the process, it may be desired that plastic film 1 is larger than shield polymer layer 2 and the other EL cell layers to facilitate its removal.

Subsequent to the forming of the non-adhesive shield layer 2, a back conductive electrode layer 3 is formed on the non-adhesive shield polymer layer 2 thereon by applying a mixture of conductive powder (e.g. encapsulated copper, graphite or silver powder) with organic polymer binder. For example the polymer binder can be a mixture of vinyl resin (20–60% by weight) and silver powder (80–40% by weight). The preferred method is screen-printing method. The thickness of this back conductive layer 3 may preferably range from about 0.001 to 0.01 inches.

Next, a dielectric layer 4 is formed on the back conductive electrode layer 3. This layer 4 may be made by mixing a dielectric powder and high-dielectric constant binder for binding the dielectric powder. The dielectric powder may be $BaTiO_3$ whose particle size is less than 1 μm. The high-dielectric constant binder, for example, may be cyanoresin or fluororesin. The dielectric layer has to be heat treated at the temperature of 80–170° C. so that the particles in the dielectric layer 4 are compactly arranged and a high dielectric constant of dielectric layer is improved. This dielectric layer 4 will preferably have a thickness of about 0.001 to 0.01 inches.

The first field polymer layer 5 is then preferably formed on the dielectric layer 4 employing high-polarity polymer with high dielectric constant, for example cyanoresin or fluororesin. The first field polymer layer preferably contains a color pigment or dye. It is also preferable to form the first field polymer layer 5 by pressing with instant heating at the temperature of 150–200° C. so that dielectric constant of dielectric layer 4 is increased. It is also possible to obtain a specific color by mixing a fluorescence dye into the first field polymer layer 5. For example, for white color emission EL the red fluorescing Rhodamin dyes are added. Suitable type of Rhodamin dye are Rhodamin 6G or Rhodamin B. This first field polymer layer 5 preferably has a thickness of about 0.001 to 0.01 inches.

Then, the phosphor layer 6 is formed on the first field polymer layer 5, by applying a mixture of phosphor powder 6(*a*) and binder 6(*b*) which binds the phosphor particle size 6(*a*). The phosphor powder may be an II–VI group compound, e.g. ZnS. The particle size of phosphor powder 6(*a*) ranges preferably about 5–30 μm. It should be noted that the amount of the phosphor powder 6(*a*) required in the invention is more than that used in the conventional phosphor layer. The binder has to be higher dielectric constant than phosphor powder. For example, it may be made of cyanoresin or fluororesin. It is preferable to form the phosphor layer 6 by heating at the temperature of 100–170° C. so that particles in the phosphor layer 6 are compactly arranged. This phosphor layer 6 preferably has a thickness of about 0.001 to 0.01 inches.

Then, the second field polymer layer 7 is preferably formed on the phosphor layer 6, by applying a raw polymer paste or a mixture of resin and the dielectric powder $BaTiO_3$ whose particle size is less than 1 μm. The second field polymer layer can contain color pigment or dye. The high-dielectric constant polymer, for example cyanoresin or fluororesin possible to obtain a color of light by mixing fluorescence dye into the second field layer 7. For example, for white EL, the red emission Rhodamin dyes are added so that about a 15% dye loading was achieved. The second field layer 7 preferably has to be heat treated at the temperature of 80–170° C. so that the particles in the dielectric powder are compactly arranged and high dielectric constant of the second field layer is improved resulting in high brightness. As a result, an upper part of the phosphor particles 6(*a*) is covered and is not in contact with the transparent electrode layer 8 as shown in FIG. 2. The thickness of this second field polymer layer 7 is preferably from about 0.001 to 0.01 inches.

The transparent electrode layer 8 is then formed on the second field layer 7 by applying a conductive polymer, for example, poly(3,4-ethylenedioxythiophene) (PEDOT:PSS), polyethylenethioxythiophene (PEDOT), or by applying a mixture of ITO powder and transparent conductive binder, for example, vinyl resin. It is preferable to form the transparent electrode layer 8 by heating at the temperature of 80–170° C. so that the particles in the transparent electrode 7 are compactly arranged. The thickness of this transparent electrode layer 8 is preferably from about 0.001 to 0.01 inches.

Then, a polymer protection layer 9 is formed on the transparent electrode layer 8 by applying high resistance polymer material. This polymer protection layer 9 is preferably made from IR acrylic resin. This polymer protection layer is applied to the transparent electrode layer and then heat treated at is 80–170° C.

After forming each of layer 2 to 9 and subjecting them to heat treatment at 100–170° C. using an IR dryer for from about 1 minute to 10 minutes; the EL cell was separated from plastic film 1. Because the non-adhesive shield polymer layer 2 has very low adhesive to plastic film 1, this can be easily accomplished. The obtained EL cell has a thickness of about 40–100 μm and has a very high flexibility.

After separating EL cell from plastic film, it can be used as regular EL lamp for back light applications.

The present invention is further described in detail by means of the following Examples and Comparisons. All parts and percentages are by weight and all temperatures are degrees Celsius unless explicitly stated otherwise.

EXAMPLE

An EL cell of the present invention was made by the following steps:

A PET substrate 1 (available from Beckhardt Specialty Films of San Diego, Calif. and having a 0.005 thickness) was placed into a commercial semi-automatic screen-printing machine (MB Model from Svecia, Inc. of Sweden). A non-adhesive shield polymer layer 2 (made of dimethyl siloxane rubber available from Sigma Aldrich) was screen printed on the substrate using the registration marks in the printer. After the screen-printing was over, the composite was transferred to an IR Forced Air Tunnel Oven Dryer available from Dorn SBE of Garden Grove, Calif. where it was derived at 140° C. for 5 minutes. This drying operation adheres the upper layer to the substrate and thus forms a laminate. The thickness of this non-adhesive shield polymer layer 2 was from 0.0004 to 0.001 inch. The width and length dimensions of this layer 2, like all of the following layers, was smaller than the comparable dimension of the substrate 1 by 0.3 millimeters on a side. This size difference allows for easy removal of the PET substrate layer 1 from the resulting laminated layers of the EL cell.

After the drying operation is complete, the resulting laminate was transferred back to the screen printer.

The rest of the layers of the EL cell were laminated in the same manner at the same thicknesses by screen-printing onto the previously made laminated layers and drying in the IR tunnel dryer at 140° C. for 5 minutes.

The next layer was the back electrode layer 3 (which was a mixture of 20% UCAR vinyl resin available from Jackson Dorssett and 80% silver powder available from Ferro).

Next, a dielectric layer 5 was screen printed and dried onto the laminate. This dielectric layer 4 was a blend of 30% fluororesin available from Dyneon and 70% $BaTiO_3$ powder available from Ferro).

Then, a first field polymer layer 5 made of 100% fluororesin from Dyneon was laminated onto the previous composite.

Then, a phosphor layer 6 was screen printed and dried onto the previous laminate. This phosphor layer 6 was a blend of 50% phosphor powder available from Osram Sylavia and 50% fluororesin available from Dyneon.

And next, the second field polymer layer 7 was formed on top of the phosphor layer 6. This layer 7 is made from the same fluororesin as the first field polymer layer 5.

And then, the front transparent electrode layer 8 was formed on the top of the previous composite. This electrode layer 8 was made of poly(3,4-ethylenedioxythiophene) (also known as PEDOT:PSS) available from Agfa.

And finally, a polymer protection layer 9 (made of IR acrylic resin available from Acheson) was formed onto the previous composite.

It should be noted that the screen printing process involves passing the materials through a fine mesh made of silk to form a uniform thick layer.

After the last polymer protection layer was laminated to place, the resulting composite was removed from the screen-printer/dryer apparatus. The PET substrate was removed to form an EL cell of the present invention.

This EL cell can be used as an EL lamp for convention purposes by passing an electric current through the EL cell by means of a front and back electrode connected to an electrical power supply.

While the invention has been described above with reference to specific embodiments thereof, it is apparent that many changes, modifications, and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. A flexible EL device composite comprising:

a) a plastic film substrate layer (1);

b) a non-adhesive shield polymer layer (2) formed on the substrate layer (1);

c) back electrode layer (3) formed on the non-adhesive shield polymer layer (2), said back electrode layer (3) comprising a mixture of a conductive powder with an organic polymer binder or conductive organic polymer;

d) dielectric layer (4) formed on the back electrode layer (3), said dielectric layer (4) comprising a mixture of high-dielectric constant powder and binder, wherein the dielectric powder has a particle size less than 1 μm;

e) first field polymer layer (5) formed on the dielectric layer (4);

f) phosphor layer (6) formed on the first field polymer layer (5), said phosphor layer (6) comprising encapsulated phosphor material and binder;

g) second field polymer layer (7) formed on the phosphor layer (6);

h) front transparent electrode layer (8) formed on the second field polymer layer (7), said transparent electrode layer (8) comprising transparent organic conductive material; and i) polymer protection layer (9) formed on the front transparent electrode layer (8).

2. The flexible EL device of claim 1, wherein the plastic film substrate layer is free from release coating material.

3. The flexible EL device of claim 1, wherein the non-adhesive shield polymer layer comprises a silicon-type resin.

4. The flexible EL device of claim 1, wherein the binder of the dielectric layer and phosphor layer is a high-dielectric constant binder.

5. The flexible EL device of claim 1, wherein the first and second field polymer layers comprise high-dielectric constant polymers.

6. The flexible EL device of claim 1, wherein the second field polymer layer comprises a high-dielectric constant binder.

7. The flexible EL device of claim 1, wherein the dielectric layer comprises a blend of 70% powder and 30% high-dielectric constant binder.

8. The flexible EL device of claim 1 wherein the second field polymer layer comprises a dielectric powder having a particle size less than 1 μm.

9. The flexible EL device of claim 1 wherein the dielectric layer has a thickness of about 0.0001 inches to about 0.001 inches.

10. An illuminating device comprising:

a. non-adhesive shield polymer layer (2);

b. back electrode layer (3) formed on the non-adhesive shield polymer layer (2) said back electrode layer (3) comprising a mixture of a conductive powder with an organic polymer binder, or comprising organic conductive polymer;

c. dielectric layer (4) formed on the back electrode layer (3), said dielectric layer (4) comprising a mixture of high-dielectric constant powder and binder;

d. first field polymer layer (5) formed on the dielectric layer (4);

e. phosphor layer (6) formed on the first field polymer layer (5), said phosphor layer (6) comprising encapsulated phosphor and binder;

f. second field polymer layer (7) formed on the phosphor layer (6), wherein the second field polymer layer comprises a dielectric powder having a particle size less than 1 μm;

g. front transparent electrode layer (8) formed on the second field polymer layer (7), said transparent electrode layer (8) comprising transparent conductive material; and h. polymer protection layer (9) formed on the front transparent electrode layer (8).

11. The flexible EL device of claim 10 wherein the non-adhesive polymer layer is selected from the group consisting of silicon-type resins, UV resins, IR resins and high resistivity polymers.

12. The illuminating device of claim 10, wherein the non-adhesive shield polymer layer comprises a silicon-type resin.

13. The illuminating device of claim 10, wherein the binder of the dielectric layer and phosphor layer is a high-dielectric constant binder.

14. The illuminating device of claim 10, wherein the first and second field polymer layers comprise high-dielectric constant polymers.

15. The illuminating device of claim 10, wherein the dielectric powder of the dielectric layer has a particle size less than 1 μm.

16. The flexible EL device of claim 10 wherein the dielectric layer comprises a blend of 70% powder and 30% high-dielectric constant binder.

17. A method forming a flexible EL device comprising the steps of:

1) forming the non-adhesive shield polymer layer (2) on the plastic film layer (1);
2) forming a back conductive electrode layer (3) on the non-adhesive shield polymer layer (2);
3) forming dielectric layer (4) comprising a mixture of high-dielectric constant powder and binder on the back conductive electrode layer (3);
4) forming first field polymer layer (5) on the dielectric layer (4);
5) forming a phosphor layer (6) comprising encapsulated phosphor and binder on the first field polymer (5);
6) forming second field polymer (7) on the phosphor layer (6);
7) forming the transparent electrode layer (8) by using conductive polymer comprising transparent conductive materials on the second field polymer layer (9);
8) forming a polymer protection layer on the transparent electrode layer (8), wherein the method of forming the EL cell layers (2–9) comprises screen printing; and
9) then separating the EL cell layers (2–9) from plastic film layer (1).

18. The method of claim 17, further comprising the step of heat treating the dielectric layer at a temperature between about 80–170° C.

* * * * *

UNITED STATES PATENT AND TRADEMARK OFFICE
Certificate

Patent No. 7,148,623 B2 Patented: December 12, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Vladimir Vlaskin, Chino Hills, CA (US).

Signed and Sealed this Thirtieth Day of January 2007.

NIMESHKUMAR PATEL
*Supervisory Patent Examiner*
Art Unit 2879